US005694099A

United States Patent [19]

Connell et al.

[11] Patent Number: 5,694,099

[45] Date of Patent: Dec. 2, 1997

[54] SWITCHING DEVICES

[75] Inventors: Richard Anthony Connell, Cottenham; Brian Stanley Darlow, Bottisham, both of Great Britain

[73] Assignee: BLP Components Limited, Suffolk, United Kingdom

[21] Appl. No.: 600,979

[22] PCT Filed: Aug. 4, 1994

[86] PCT No.: PCT/GB94/01716

§ 371 Date: Feb. 12, 1996

§ 102(e) Date: Feb. 12, 1996

[87] PCT Pub. No.: WO95/05671

PCT Pub. Date: Feb. 23, 1995

[30] Foreign Application Priority Data

Aug. 19, 1993 [GB] United Kingdom ..... 9317260

[51] Int. Cl.[6] ..... H01H 51/22

[52] U.S. Cl. ..... 335/78; 335/128

[58] Field of Search ..... 335/78–86, 124, 335/128, 131

[56] References Cited

U.S. PATENT DOCUMENTS 5,227,750 7/1993 Connell et al. ..... 335/86

5,515,019 5/1996 Schedele ..... 335/78

*Primary Examiner*—Lincoln Donovan

*Attorney, Agent, or Firm*—Lee, Mann, Smith, McWilliams, Sweeney & Ohlson

[57] ABSTRACT

A switching device (220) comprises a solenoid actuator (224) and an inlet terminal (224) attached to a first bus-bar (246). Mounted on the bus-bar is a flexible switch blade (236) operable by the actuator and having a movable contact (240) at its free end. An outlet terminal (254) is connected by a second bus-bar (250) to a fixed contact (242) of the contact pair, the arrangement being such that in use an electrodynamic force is produced at least between the blade (236) and the first bus-bar (246) which tends to maintain the contacts (240, 242) in engagement.

3 Claims, 3 Drawing Sheets

SWITCHING DEVICES

FIELD OF THE INVENTION

The present invention relates to switching devices, such as relays, which incorporate solenoid actuators.

BACKGROUND OF THE INVENTION

In International (PCT) Publication No WO 91/19314 there is described and claimed a switching device comprising a solenoid actuator, a lever made of electrically insulating material pivotally mounted for movement by the actuator, a flexible switch contact bearing element having a movable contact at one end for engagement with a fixed contact, and connection means connecting the lever to the contact bearing element to move the contacts between open and closed states.

Whilst such a switching device operates satisfactorily in normal applications, it has been found that under extremely high current conditions, eg short-circuit conditions, a repulsion force is generated which tends to part the pairs of contacts, which may cause serious damage to the switching device.

It is an object of the present invention to provide an improved switching device without the foregoing disadvantage.

SUMMARY OF THE INVENTION

According to the present invention there is provided a switching device comprising a solenoid actuator, a first terminal attached to a first bus-bar on which is mounted a flexible switch blade operable by the actuator and having a movable contact at its free end, and a second terminal connected to a fixed contact with which the movable contact is engageable, the arrangement being such that when in use the device is in the ON condition the resultant current flow produces an electrodynamic force between the blade and the first bus-bar which tends to maintain the contacts in engagement.

In an advantageous arrangement in accordance with the invention, the first and second terminals of the switching device, together with the related contact sets and bus-bars, together referred to hereinafter as the "switching assembly" are physically arranged within the device such that under conditions of high (eg short-circuit) current in the external circuit switched by the device, the current flow through the switching assembly is able to reduce repulsion forces occurring between the fixed and movable contacts and to cause the force applied to close the contacts to be increased electrodynamically.

In this way inadvertent opening of the contacts under high current or short-circuit conditions, which could lead to arcing and potential destruction of the switching device, may be largely avoided.

BRIEF DESCRIPTION OF THE DRAWINGS

Embodiments of the invention, given by way of example only, will now be described with reference to the accompanying drawings in which.

Figure 1A:
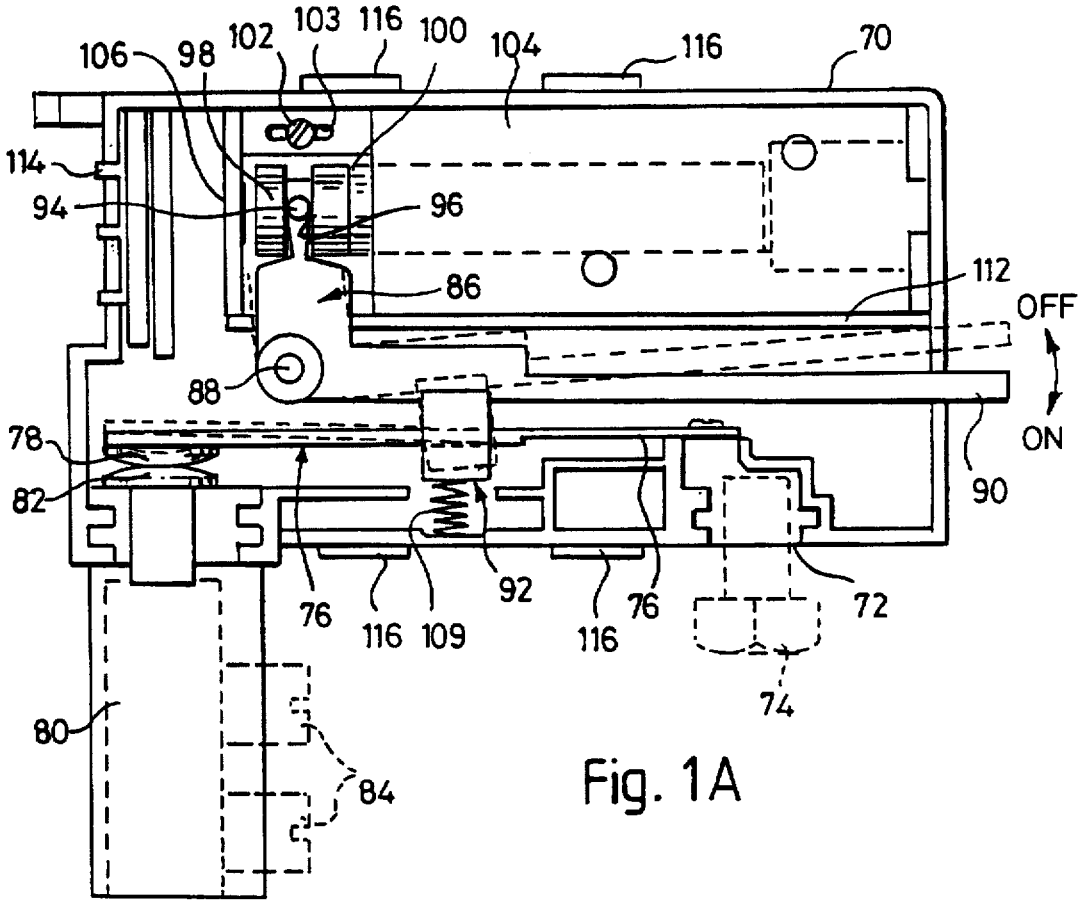
FIGS. 1A to 1C together show a plan view and two scrap views of a known switching device.
Figure 1B:
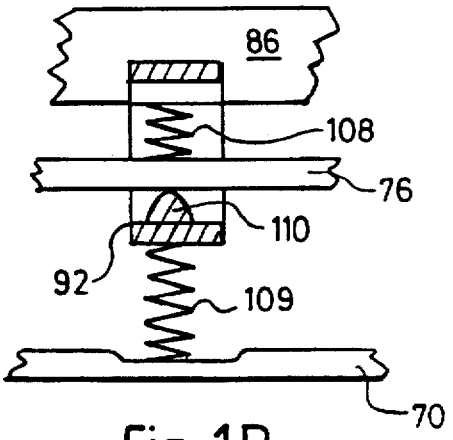

Referring first to FIGS. 1A and 1B, there is shown a known single-pole power relay or contactor switch configured for switching industrial or domestic electrical loads, typically at 100 A and 250 V AC.

The relay is housed in a split moulded case 70 open initially for assembly and adjustment, and then closed to provide protection from shock and from the ingress of dust. The case is shown open in the drawing.

One power terminal 72 comprises a heavy metallic block with integral fins which engage positively in slots in case 70. Connection is made to external wiring by means of a bolt 74 engaging in the threaded hole in the terminal end face.

The moving part of the relay switch comprises a high conductivity blade 76 which is partly reduced in section towards its fixed end 76A to create flexibility and ease of movement. The fixed end of the blade is suitably attached by welding, screwing or rivetting to the inside face of terminal 72. A switching contact 78 attached to the free end of blade 76 is made of an alloy suitable for the magnitude of the switching currents likely to be encountered.

The second power terminal 80 is engaged positively at the other end of the moulded casing similarly to terminal 72, again using fins and slots. A second fixed contact 82 suitably attached to the inside face of terminal 80 is made of the same alloy as the moving blade contact. Both contacts are arranged so that optimum face-to-face alignment takes place. Connection to terminal 80 is made via the associated socket in which wiring is retained by grub screws 84.

The switching action is arranged to be such that contacts 78 and 82 make with adequate mating force so as to carry the high load currents and minimise heating effect due to those currents.

Actuation of the switch blade 76 is achieved via a non-conducting moulded link-arm-lever 86 pivoted as shown by a pin 88 in bearing bushes or within a bearing boss raised off the base of the case 70 to permit rotation. An extension 90 of the lever 86 extends through a slot in the case 70 to permit manual operation of the relay, for example for test or resetting purposes. The extension 90 also serves as a flag to indicate the current state of the relay.

Figure 1C:
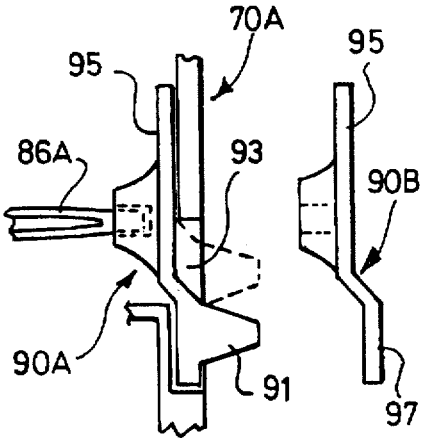

In a modification, shown in FIG. 1C, the extension instead comprises a separate part 90A connectable over the end of a slightly modified lever 86A. The extension part 90A includes a manually engageable protruberance 91 projecting through an aperture 93 in the casing 70A, so that its alternative positions are clearly visible (the upper position being shown chain dotted). The part 90A also includes a sliding portion 95 movable along the inside surface of the casing 70A.

Where the option of a manual operation of the relay/switch is not required, the part 90A may readily be replaced by an alternative part 90B, shown to the right of FIG. 1C. The part 90B is similarly connectable over the lever 86A, but has a flat portion 97 in place of the protruberance 91 of the part 90A. Thus the part 90B serves only as a flag to indicate the two positions or states of the relay/switch.

In order to improve their visibility, the parts 90A and 90B are preferably made of a different colour from the casing 70A, for example the casing may be black while the parts 90A and 90B are orange.

Integral with the lever 86 shown in FIG. 1B, is the U-shaped saddle member 92 through which the moving blade 76 passes and by means of which the blade is moved.

The actuating lever 86 is clipped pivotally by a U-shaped stir-up 94 to a slot 96 in the head 98 of plunger 100 of the magnet-assisted solenoid. The solenoid assembly is adjustably clamped into the base part of case 70 by at least two mounting screws, one of which is shown at 102, each screw passing through a slot 103 in a bracket of the assembly, and the longitudinal axis of the slot being parallel to the solenoid axis. The plunger 100 moves axially in the solenoid and that axial movement is translated to rotational movement of the lever 86.

In an alternative arrangement, the screws 102 are replaced by plastic pins (not shown) which protrude through the slots 103. When the solenoid assembly has been suitably positioned, it is clamped in position by heat-staking or ultrasonic staking of the plastic pins so as to prevent further movement.

In operation, the relay is set into the ON position when the appropriate coil of the winding 104 is pulsed with a suitable DC voltage and plunger 100 is drawn into the solenoid. This state is held indefinitely without any energisation of the winding until a pulse is applied to the other coil of the winding 104, when the plunger 100 is withdrawn from the solenoid and engages the inner face of extension piece 106. This condition will again be maintained indefinitely without energisation of either winding. In the OFF condition the position of blade 76, lever 86 and lever extension 90 is as shown in dotted outline in the drawing.

The extension piece 106 is located at such a position as to provide the required working stroke of the plunger 100. This may be achieved by forming the piece 106 out of yoke frame 107 extending around the winding 104, the piece 106 being bent up at right angles to the axis of the plunger so as to provide the required plunger stroke.

The pick-up position of the switch-blade 76 is so determined as to provide positive drive and switching action with minimal contact bounce. In the ON direction the downward translated contact force is provided by a small compression spring 108 (or alternatively by a suitable leaf spring) trapped within the member 92 and engaging switch blade 76. In the OFF direction a lower radiussed face 110 of the member 92 picks up blade 76 and snaps open the contacts 78/82. This snap action minimises the effect of contact arcing due to the cessation of the load current through the contacts.

To assist speedy contact arc breaking when the switching contacts are opened, a further compression coil spring 109 is provided between member 92 and the adjacent inner face of case 70. The spring also improves the "feel" of the manual switching action.

Adjustment of the contact separation between contacts 78 and 82 (and hence also of the contact pressure when closed) is simply achieved in manufacture, or subsequently, by simple adjustment of the solenoid along its principal axis by loosening the mounting screws 102 which pass through the slots 103. This movement is transmitted to the moving contact of the switch via the pivotted lever, linked at its other end to the solenoid plunger.

In an arrangement which is particularly suitable during manufacture, the adjustment is achieved by provisionally replacing the fixed contact 82 with a shorter contact, ie whose contact face is further from the movable contact 78. The solenoid is then adjusted until the contacts just touch when closed. When the original contact 82 is replaced there will then exist the correct contact pressure between the contacts.

The necessary electrical isolation between the low voltage DC winding, the metal parts of the solenoid and the 250 V AC on the switch blades and contacts, is provided by a barrier wall 112 integrally moulded into case 70.

Connections to the winding coils are made via socket 114, located in a slot in case 70, terminated by flying leads or a flexible printed circuit. Clip ears 116 are provided upon case 70 for locating and clipping the case in an associated moulding cover (not shown) through which the main terminal connections may be made.

Although the switching device above described employs as actuator a bistable permanent magnet solenoid, there may instead be employed other forms of solenoid actuator, in which the plunger is held at the end points of its travel by permanent magnet or electromagnetic or mechanical means.

Whilst a switching device such as is described herein in relation to FIG. 1 is able to satisfactorily meet relevant IEC specifications, the arrangement of the switching assembly is such that under extremely high current conditions (such as may for example result from a short-circuit condition in the external circuit switched by the device) the current distribution and direction of flow through the switching assembly of the device are such that a repulsion force is generated between the moving contact 78 and the fixed contact 82. The effect of this force is to attempt to part the contacts against the closure forces acting upon the moving contact blade 76, due to the actuating solenoid and compression spring 108 within saddle member 92 overlying blade 76.

At high values of load current (eg in excess of 3000 A) such as may be met with in short-circuit conditions and as may be applied in a short-circuit-withstand test, the repulsion force between the fixed and moving contacts, reinforced with high electrical stress fields flowing around the terminals and the moving switch blade, is appreciable compared with the closure force of compression spring 108. This repulsion force may then spuriously open the closed contacts 78 and 82, creating a catastrophic breaking arc, which can cause serious, if not totally destructive, damage to the switching device.

Adoption of modified forms of switching assembly (as defined above), within the constraints of the switch casing and subject to various user requirements, has permitted such repulsion forces to be minimised to thereby prevent spurious separation of the contacts, and to cause the net effect of the high current flow through the switching assembly to produce an enhancement of the closure pressure upon the contacts under such conditions.

Figure 2:
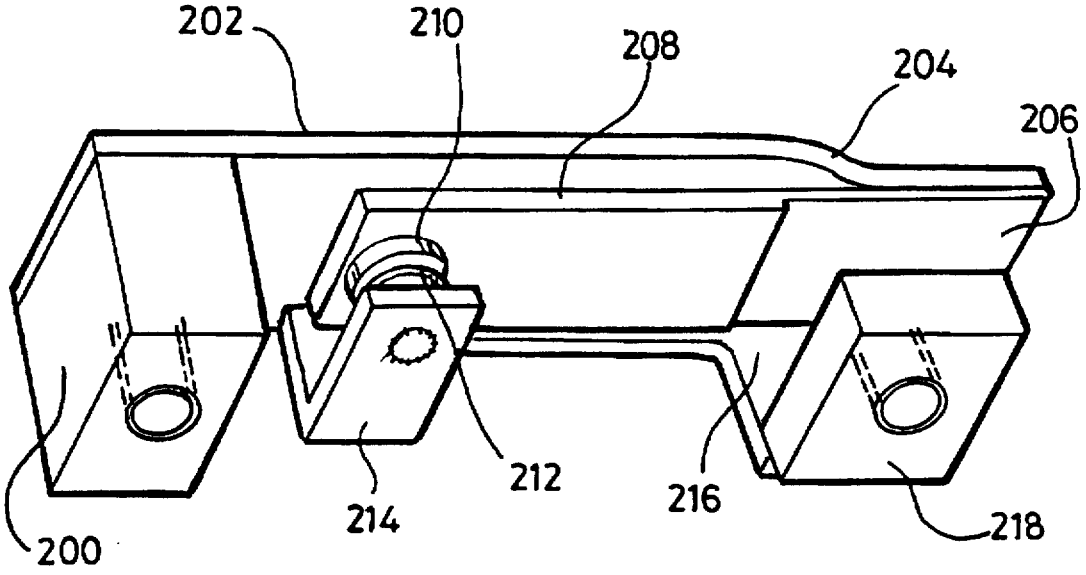
FIG. 2 shows a perspective view of an improved switching assembly (as hereinbefore defined) for a device of the general type shown in FIG. 1.
Figure 3:
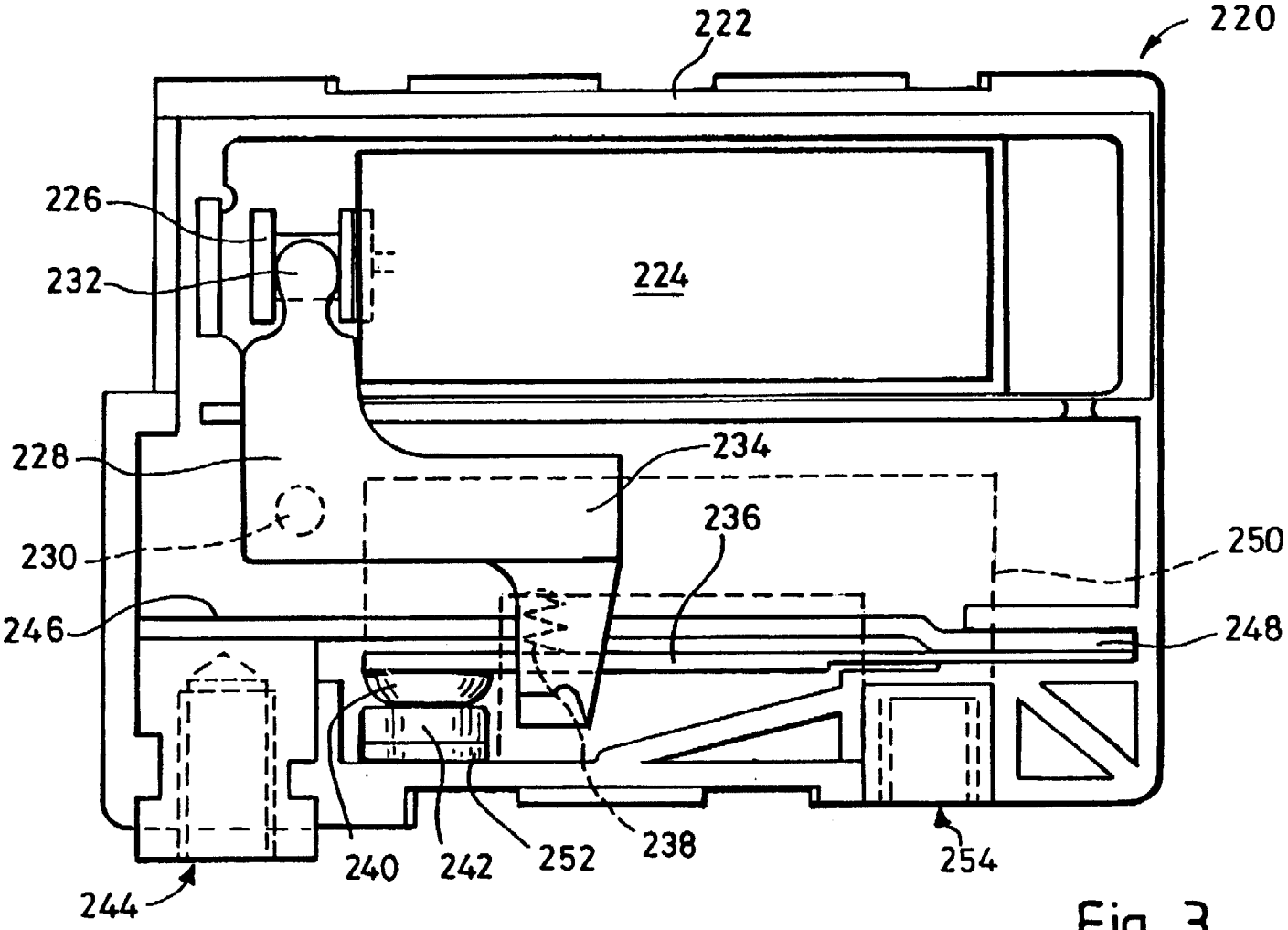
FIG. 3 shows a diagrammatic illustration of a device of the general type shown in FIG. 1 incorporating an improved switching assembly.

Referring now to FIGS. 2 and 3 of the drawings:

FIG. 2 shows a perspective view of one form of improved switching assembly (as defined) which may be incorporated into a switching device such as is illustrated in FIG. 1; and FIG. 3 shows a diagrammatic illustration of a switching device, generally similar to that of FIG. 1, incorporating a further form of improved switching device, generally similar to that of FIG. 1, incorporating a further form of improved switching assembly.

Referring to FIG. 2, the switching assembly comprises:

a) an input terminal 200;

b) a copper or similarly conductive bus-bar 202 disposed at right angles to the input terminal 200 and suitably affixed to it by means of welding, brazing or screwing;

c) attached to the inward curving end 204 of bus-bar 202, the flexible portion 206 of a high-conductivity moving switch blade 208 which carries moving contact 210, with the flexible portion 206 being suitably welded, screwed or brazed to the inner face of the end 204 of bus-bar 202 such that bus bar 202 and blade 208 run parallel with one another, for a substantial portion of their; lengths, separated by a minimal gap sufficient to allow the switching function. In the unmade condition there is a nominal gap between moving contact 210 and the underlying fixed contact 212 for electrical isolation;

d) fixed contact 212 carried upon lug 214 formed as part of a bus-bar 216;

e) bus-bar 216, of copper or other suitably conductive material, which is welded, brazed or screwed to f) output terminal 218.

When incorporated into the casing of a switching device, such as shown in FIG. 1, input terminal 200 and output terminal 218 are both tightly located in the wall of the device casing; and castellations and slots or the like formed upon the terminals engage complementary formations in the casing wall, as shown in FIG. 1A.

FIG. 3 shows, diagrammatically in partial cross-section, a switching device 220 incorporating an improved switching assembly in accordance with the invention.

Switching device 220, comprises a moulded electrically insulating casing 222, a solenoid actuator 224 with a plunger 226 and a pivot arm 228 pivotted at 230, with one end 232 coupled to the outer end of plunger 226, and the other end 234 bridging and engaging a moving switch blade 236 of the switching assembly. Within the bridging member 234 of pivot arm 228, a compression spring 238 (similar to spring 108 of FIG. 1) is seated to engage moving blade 236 and provide a further positive pressure to hold moving contact 240 in engagement with fixed contact 242, when pivot arm 228 is in the position to cause the fixed and moving contacts to engage as shown.

The switching assembly of the device 220 comprises a first inlet terminal 244, a first inlet bus-bar 246, a switch blade 236 which is mounted upon the inwardly canted end 248 of bus-bar 246 and carries moving contact 240; and a second outlet bus-bar 250 which has a lug 252 at one end bearing fixed contact 242, and is attached to outlet terminal 254 at the other end.

The inlet bus-bar 246 and moving contact assembly is carried by inlet terminal 244, and the fixed contact and output bus-bar assembly is carried by outlet terminal 354, the positioning of the inlet and outlet terminals in the casing 222 of switching device 220 determining the disposition of the switching assembly within the casing 222.

Contacts 240 and 242 are shown made in FIG. 3 such that a path exists for current flow between inlet terminal 244 and outlet terminal 254. Switching is achieved in this path by operation of solenoid actuator 224, causing pivot arm 228 to move switch blade 236 and moving contact 240 towards fixed contact 242. The contacts 240 and 242 are opened to break the current path by operation of the solenoid actuator 224 so as to move plunger 226 out of the solenoid, causing pivot arm 228 to move and thereby move switch blade 236 towards input bus-bar 246.

When the switch is in the "made" condition, the flow of the same current in opposite directions in the parallel paths, which respectively comprise the inlet bus-bar 246 and the moving switch blade 236, generates an electrodynamic force between them, tending to move the switch blade 236 away from the fixed inlet bus-bar 246 thereby to increase the force applied to moving contact 240, and thus to resist any tendency of the contacts to separate under conditions of high current.

Additionally, the outlet bus-bar 250 is shaped and designed so as to be positioned away from the switch blade 234, in such a manner as to add to the electrodynamic force created by inlet bus-bar 246.

The operation of the switching assembly shown in FIG. 2 is identical to that described in relation to the assembly incorporated in the complete switching device of FIG. 3, the difference in the two switching assemblies being confined to the dispositions of the respective outlet bus-bars.

As an illustration of the advantage to be achieved by employment of an improved switching assembly (as defined) in a switching device of the type shown in FIG. 1, the increase in contact force achieved when an improved switching assembly was incorporated, relative to that of a device of the type shown in FIG. 1, was approximately 500 gF at a current of 3000 A rms.

In both the switching assemblies of FIGS. 2 and 3, to further reduce the possibility of inadvertent contact separation under excess current, the fixed and moving contacts are both of the smallest dimensions consistent with the capacity to pass the rated load current of the device.

At high operating currents (eg 200 A rms) the contact 240 for the moving blade 236 is advantageously of a bifurcated shape (not shown), thus reducing the constriction current on each contact and enhancing the short-circuit performance of the switching device.

We claim:

1. A switching device comprising a solenoid actuator, a first terminal attached to a first bus-bar on which is mounted a flexible switch blade operable by the actuator and having a movable contact at its free end, and a second terminal connected to a fixed contact with which the movable contact is engageable, the arrangement being such that when in use the device is in the ON condition the resultant current flow produces an electrodynamic force between the blade and the first bus-bar which tends to maintain the contacts in engagement, and in which the fixed contact is connected to the second terminal by a second bus-bar which is of an arched shape closely positioned on the side of the first bus-bar away from the switchblade, so as to produce in use a further electrodynamic force on the blade.

2. A switching device according to claim 1 in which the switch blade is connected to the free end of the first bus-bar and is aligned closely parallel thereto.

3. A switching device according to claim 1 in which the movable contact comprises bifurcated contacts, thereby reducing the constriction current on the contact.

* * * * *